US005593137A

United States Patent [19]

Johnson

[11] Patent Number: 5,593,137

[45] Date of Patent: Jan. 14, 1997

[54] BI-DIRECTIONAL ELEVATING AND RACK-ATTACHED SUPPORT DEVICE FOR POSITIONING MODULES DURING INSTALLATION AND REMOVAL FROM RACKS

[76] Inventor: Charles L. Johnson, 177 Old Canton Hills Dr., Jackson, Miss. 39211

[21] Appl. No.: 414,798

[22] Filed: Mar. 31, 1995

[51] Int. Cl.[6] ..... B66F 3/22

[52] U.S. Cl. ..... 254/122; 254/126; 269/60; 269/79; 269/904; 182/82; 182/141

[58] Field of Search ..... 254/7 C, 8 C, 254/122, 126, 124; 182/63, 69, 82, 141; 269/60, 79, 904

[56] References Cited

U.S. PATENT DOCUMENTS

| | | | |
|---|---|---|---|
| 2,689,412 | 9/1954 | Young | 269/46 |
| 2,805,902 | 9/1957 | Von Drasek et al. | 182/82 |
| 2,846,275 | 8/1958 | Esch | 182/141 |
| 3,003,746 | 10/1961 | Gridley | 254/122 |
| 3,082,843 | 3/1963 | Leonard | 182/82 |
| 4,447,042 | 5/1984 | Masui | 254/122 |
| 4,673,060 | 6/1987 | Gregory | 182/82 |
| 4,725,183 | 2/1988 | Smillie, III | 254/7 R |
| 5,379,855 | 1/1995 | Juang | 254/122 |

*Primary Examiner*—Bruce M. Kisliuk
*Assistant Examiner*—Thomas W. Lynch
*Attorney, Agent, or Firm*—Ben E. Lofstedt, Patent Attorney

[57] ABSTRACT

An bi-directional, adjustable elevating and support mechanism to assist in the removal, installation and repair of rack-mounted items such as electronic telecommunications modules by supporting and aligning such modules during the removal, installation and repair of such modules from support racks.

3 Claims, 1 Drawing Sheet

BI-DIRECTIONAL ELEVATING AND RACK-ATTACHED SUPPORT DEVICE FOR POSITIONING MODULES DURING INSTALLATION AND REMOVAL FROM RACKS

BACKGROUND OF THE INVENTION

1. Field of the Invention

The present invention relates to an elevating and rack-attached support mechanism, and, more particularly, to an adjustable, bi-directional elevating mechanism for supporting and aligning rack-mounted modules during the disposition of such modules outside of the rack during the process of removal, installation and repair of such modules.

2. Description of the Prior Art

In the telecommunications industry, numerous electronic modules are used to process and amplify various telecommunications signals. In order to provide an orderly arrangement for operational access to each of the individual modules, it is necessary that this modules be supported in vertically-arranged support racks. Such racks provide not only for support of each of these many telecommunication modules, but allow ready and convenient access for installation and removal of such modules as well.

However, such modules are frequently bulky and occupy a significant amount of space, can be relatively heavy, and, given the relatively confined areas in which the racks are situated, it is often a problem to install, remove, repair and replace such telecommunications modules into and out of these support racks.

Given such conditions and the circumstances involving frequent removal and replacement of such modules, such arrangement oftentimes presents needless and unnecessary safety hazards for telecommunications workers performing such tasks.

To overcome these problems, I designed what I call a "Rack Assist". This device is primarily a mechanical method of stabilizing and aligning the mounting hardware on the telecommunications modules to the mounting hardware on the racks. More descriptively speaking, the "Rack Assist" is a moveable platform designed for use as a vertically moveable lift for telecommunications equipment items which are typically mounted in a vertical rack, each item of equipment arranged in a multilayered, "sandwich-like" fashion.

Some prior art patents relating primarily to lifting and leveling mechanisms were found in the prior art, such as U.S. Pat. No. 3,935,600 related to a mechanism for raising and lowering the bottom of a swimming pool and is self-locking. A long, lead screw is provided in conjunction with a pair of scissor-lift type mechanism for raising and lowering the supported platform which serves as a "bottom" for a swimming pool.

Another device found in the prior art is disclosed in U.S. Pat. No. 4,221,280 relates to a bi-level platform lift mechanism. A hydraulically actuated conventional scissor-lift is used to both support and raise or lower a top platform. The platform, in turn, is adjustable to the desired elevation.

In a yet still further U.S. Pat. No. 4,405,116, a mechanism was found which is described as an adjustable pedestal trestle which is especially useful for theater stages and the like. It consists of a platform carried by a top frame which, in turn, is support and elevatable by a scissors mechanism which is controlled by a drive motor attached to a vertical adjustment device consisting of a lead-screw arrangement as shown in the drawing.

Still further, another U.S. Pat. No. 4,526,346 was found to teach the use of a scissors operated and supported elevating table. A special modification of this relatively standard device amplifies and accelerates the initial opening of the scissors legs from the collapsed or horizontal position of the unit.

U.S. Pat. No. 4,725,183 was found to relate to a power-assisted lifting mechanism for installation in the trunk of a car to allow items to be placed therein and removed therefrom. The device is a combination of a scissors jack and a reversible electric motor for powered operation thereof. The top platform incorporates a horizontally movable, slide-drawer type mechanism for manually moving the platform from one horizontal position to another.

In another version of a lifting device, U.S. Pat. No. 4,867,277 was found to disclose a portable lifting device mounted on top of a cart with wheels. A plurality of stabilizer legs and struts are incorporated for stability.

U.S. Pat. No. 4,941,797 teaches an improved lift mechanism similar to U.S. Pat. No. 4,725,183.

A somewhat complicated multiple scissors lift mechanism for elevating a platform is disclosed in U.S. Pat. No. 5,379,855. A pair of lead-screw mechanisms are provided for controlling the elevation of the platform above the base.

SUMMARY OF THE INVENTION

Fundamentally, the invention consists of a bi-directional, adjustable elevating mechanism to assist in the removal, installation and repair of rack-mounted items such as electronic telecommunications modules by supporting and aligning such modules during the removal, installation and repair of such modules from support racks.

It is one primary and important object of the invention is to provide a convenient and safe means for readily removing, installing and supporting rack-mounted modules during the process of removal, installation and alignment of such modules with respect to the racks.

Another primary and important object of the invention is to provide a vertically-adjustable, horizontally-disposed platform conveniently securable to a rack for supporting and working on telecommunications equipment.

It is yet still further significant and important object of the present invention to provide a rack-mounted, vertically-adjustable platform for aligning rack-mounted telecommunications equipment to the rack for removable securement thereto.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
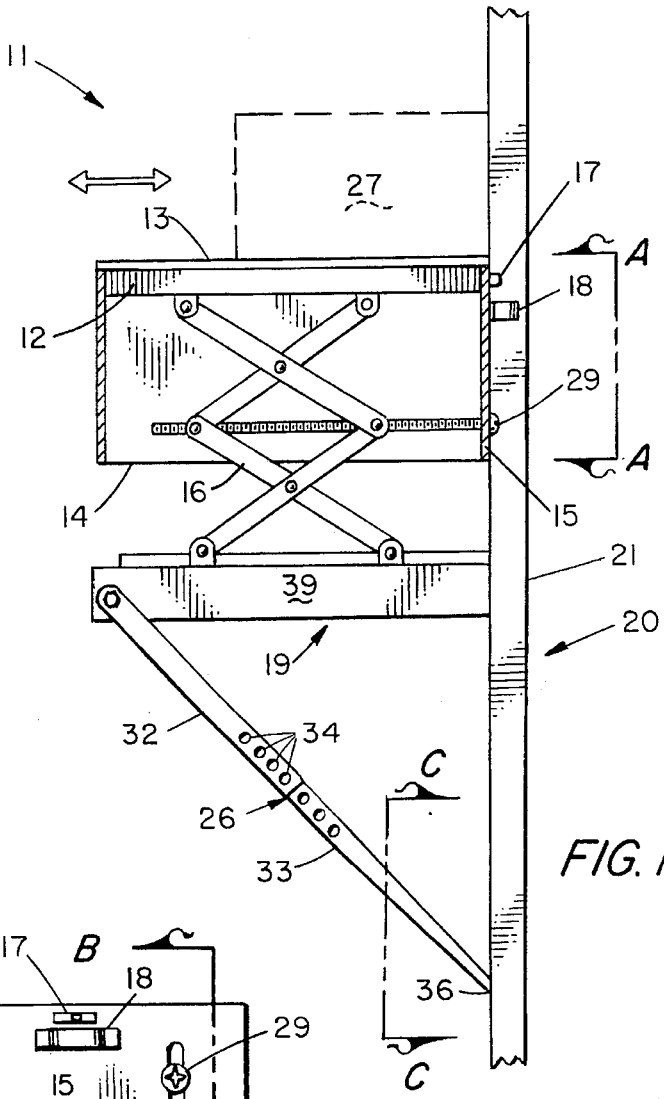
FIG. 1 is a side elevational view of the preferred embodiment of the present invention taken along Plane B—B of FIG. 2.
Figure 6:
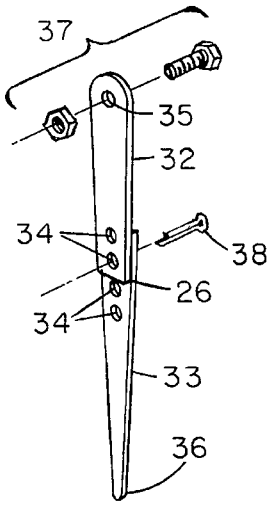
FIG. 6 is a perspective view of the extensible support leg which is pivotally secured to the table of the support platform of the present invention.

With continued reference to all of the drawings herein, and with special emphasis now on FIG. 1, there is shown an bi-directional elevating device, generally indicated at 11, having a worktop 12, which is topped with a low-friction plastic cover 13, made from Teflon, Delron, or the like, a skirt 14 depending from the worktop 12, the skirt 14 having a front panel section 15, and a pair of adjustable, bi-directional, elevating devices, such as scissor lifts 16, a level indicator 17, a carrying handle 18, a platform 19 secured to a support rack 20 formed typically of four (4) angle iron or steel supports 21, 22, 23 and 24 having a plurality of apertures 25 therein, and adjustable support legs 26 which are pivotally connected to the platform 19 and removably secured to the support 21 via one of the apertures 25.

Figure 3:
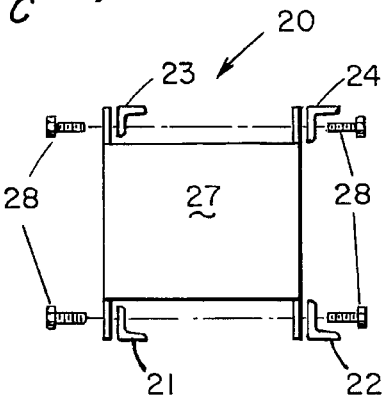
FIG. 3 is a top view of a typical telecommunications module mounted to a rack.

In the telecommunications industry, various bulky and relatively heavy telecommunications equipment modules 27 are stacked and mounted on a support rack 20 which typically consists of a one or two pairs of angle iron or steel elements 21, 22 and 23, 24; the elements 21, 22 are shown as the front pair of elements and elements 23, 24 are shown as the rear pair of elements, both pairs of elements forming what is generally referred to as the support rack 20. As depicted in FIG. 3, these two pair of elements 21, 22 and 23, 24 provide for support of the telecommunications module 27 at all four (4) corners of the module 27). Each element 21, 22, 23 and 24 is vertically arranged with a plurality of slots 25 therein to allow the telecommunications equipment module 27 to be removably secured thereto, typically by screws 28 or nut-and-bolt combinations. The plurality of slots 25 in the pair of angle iron or steel elements 21, 22 are typically arranged so that the distance between the centerlines of the plurality of slots 25 in the angle iron or steel elements 21, 22 is set at 19 inches. With this in mind, a useful, but obviously not mandatory, worktop 12 width of approximately 21 inches is set to span the elements 21, 22 and it is convenient to set the depth at 18 inches or so.

An adjustment screw 29 is provided for each of the scissor lifts 16 for raising and lowering the worktop 12 as necessary to align the telecommunications modules with respect to the rack 20. (Only one of the two scissor lifts 16 is shown in the drawings; the other one is behind the first one.)

It should be noted at this time that the scissor lifts 16 are but one means for raising or lowering the worktop 12. Hydraulic means or air bag means could readily be utilized as well for the bi-directional elevational lifting means.

The carrying handle 18 is mounted on the front panel section 15 of the skirt 14 so that this compact bi-directional, adjustable elevating and support mechanism, can be readily transported to another work site.

The level indicator 17 is typically of the bubble-in-liquid type and is mounted on the front panel section 29 of the skirt 14 for indicating whether or not the worktop 12 is horizontal or "level". This is important in order to align the telecommunications module 27 for installation in the rack 20 or for removal from the rack 20.

The worktop 12 is topped with a low-friction plastic cover 13, made from Teflon, Delron, or the like, to allow the telecommunications module 27 to be easily removed and installed in the rack 20.

By utilizing two scissor lifts 16, the vertical positioning of the worktop 12 can be adjusted by the adjustment screws 29 which are mounted on the front panel section 15 of the skirt 14 which depends from the worktop 12, and allows the telecommunications module 27 to be adjusted with respect to the slots 26 in the angle iron or steel elements 21, 23 so that the module 27 can be secured thereto.

The two scissor lifts 16 are secured by conventional means to both the worktop 12 and the platform 19. Such means can be by the use of screws, or bolts-and-nuts, or the like.

The scissor lifts 22 are mounted on top of a support platform 19 which is removably mounted to the angle iron or steel elements 21, 23 of the rack 20. The support platform 19 consists of a table 39 is removably supported from the elements 21, 23 by a plurality of hooks 30, as shown in FIG. 5, secured to the rear portion of the platform 19.

A pair of adjustably extensible legs 26 (only one is shown in FIG. 1; the other leg 31 is directly behind the one shown). Each of the legs 31 is pivotally hinged to the front portion of the platform 19 and are identical. As detailed in FIG. 1, the leg 31 has two sections 32, 33. Each section 32, 33 having a plurality of apertures 34 therein; one section 32 has a hole 35 at the extreme end, and the other section 33 has a tapered end 36 at its extreme end. Each of the legs 31 are pivotally secured via the nut-and-bolt combination 37 through the hole 35 and a corresponding hole in the platform 19. The length of the legs 31 are adjusted for the desired length and a cotter pin 38, or the like, is passed through matching apertures 34 in the two sections 32, 33 of the legs 31, thereby locking the two sections 32, 33 together to form the leg 26. Both legs 26 are adjusted to provide equal, level support.

Figure 5:
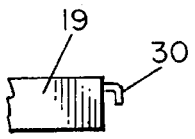
FIG. 5 is an enlarged side elevational view of the rear portion of the table of the present invention.
Figure 4:
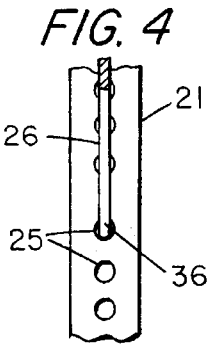
FIG. 4 is a view taken along Plane C—C of FIG. 1.
Figure 2:
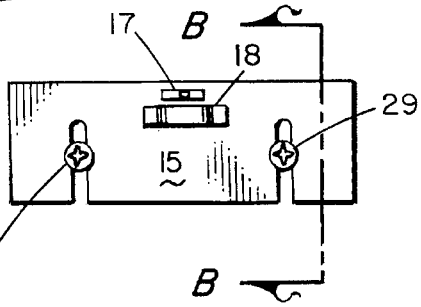
FIG. 2 is a front elevational view of the front portion of the invention taken along Plane A—A of FIG. 1.

To mount the bi-directional elevating device, generally indicated at 11, to the rack 20, the hooks 30 mounted on the rear of the platform 19 are mounted to the angle iron or steel elements 21, 23, via a pair of hooks 30 (only one is shown in FIG. 5 as the other hook 30 is directly behind the hook 30 shown), which are locked into the desired slots 25 in elements 21, 23. Once locked in position, the tapered end 36 of the legs 26 are placed into the desired slots 25 on the elements 21, 23. Once this is done, the platform 19 is locked into position and becomes a stable platform 19 for supporting the bi-directional elevating device 11 and the weight of the telecommunications module 27.

The entire bi-directional elevating device 11 is portable, and when broken down, it can be carried in a nylon bag, or simply lashed together with one or more nylon straps with Velcro tape on opposite ends and the handle 18 used to carry the entire bi-directional elevating device 11 to the next work site.

The foregoing constitutes my disclosure of the best mode known by me at the time of filing this patent application for carrying out this invention. The embodiment shown is, however, only illustrative and does not limit the scope of the inventive concept. It is recognized that one of skill in the art may produce an operative assembly which may have differences without departing from the true concept of this invention. Therefore, this invention is defined, not by the illustrative embodiment but rather by the following claims including the protection afforded by the Doctrine of Equivalents.

What I claim as my invention is:

1. An improved combination device for assisting in the installation, removal and repair of items such as electronic telecommunications modules which are mounted in a rack, comprising:

a. a support platform adapted to be removably mounted to at least a pair of vertically-arranged, spaced-apart elements having a plurality of apertures therein and forming a rack means for mounting modules thereto;

b. a bi-directional adjustable elevating and support mechanism adapted to be operatively supported by the support platform, said mechanism comprising:

a work platform;

scissor lift means operably secured between said support platform and said work platform for bi-directional elevation of said work platform;

panel section means operably secured to the front of said work platform and depending therefrom;

handle means operatively secured to said front section panel means; and c. level indicator means operably secured to said front panel section means.

2. An improved combination device for assisting in the installation, removal and repair of items such as electronic telecommunications modules which are mounted in a rack, comprising:

a. a support platform adapted to be removably mounted to at least a pair of vertically-arranged, spaced-apart elements having a plurality of apertures therein and forming a rack means for mounting modules thereto, wherein said support platform comprises:

a table;

a pair of hooks mounted to the rear of said table; and a pair of adjustably extensible legs for providing support for said table and disposed between said table and said pair of vertically-arranged, spaced-apart elements having a plurality of apertures therein forming rack means for mounting modules, said pair of legs being pivotally secured at one end to the extremity of the table which is furthest from said rack means and at the opposite end being tapered for engagement in the desired aperture in one of the pair of rack elements;

b. a bi-directional adjustable elevating and support mechanism adapted to be operatively supported by the support platform, said mechanism comprising:

a work platform;

scissor lift means operably secured between said support platform and said work platform for bi-directional elevation of said work platform;

panel section means operably secured to the front of said work platform and depending therefrom, and handle means operatively secured to said front section panel means.

3. An improved combination device for assisting in the installation, removal and repair of items such as electronic telecommunications modules which are mounted in a rack, comprising:

a. a support platform adapted to be removably mounted to at least a pair of vertically-arranged, spaced-apart elements having a plurality of apertures therein and forming a rack means for mounting modules thereto;

b. a bi-directional adjustable elevating and support mechanism adapted to be operatively supported by the support platform, said mechanism comprising:

a work platform;

scissor lift means operably secured between said support platform and said work platform for bi-directional elevation of said work platform;

panel section means operably secured to the front of said work platform and depending therefrom, and, further comprising a panel section having a pair of slots therein for allowing the adjusting elements for the scissor lifts to move up and down freely; and handle means operatively secured to said front panel section means.

* * * * *